US010096420B2

(12) United States Patent
Maeno et al.

(10) Patent No.: US 10,096,420 B2
(45) Date of Patent: Oct. 9, 2018

(54) REACTOR

(71) Applicant: TAMURA CORPORATION, Tokyo (JP)

(72) Inventors: Kensuke Maeno, Sakado (JP); Masashi Yamada, Sakado (JP)

(73) Assignee: TAMURA CORPORATION, Tokyo (JP)

( * ) Notice: Subject to any disclaimer, the term of this patent is extended or adjusted under 35 U.S.C. 154(b) by 21 days.

(21) Appl. No.: 15/160,625

(22) Filed: May 20, 2016

(65) Prior Publication Data

US 2016/0343490 A1 Nov. 24, 2016

(30) Foreign Application Priority Data

May 21, 2015 (JP) ..... 2015-103960

(51) Int. Cl.

| | |
|---|---|
| ***H01F 27/30*** | (2006.01) |
| ***H01F 27/29*** | (2006.01) |
| ***H01F 27/28*** | (2006.01) |
| ***H01F 27/32*** | (2006.01) |

(52) U.S. Cl.

CPC ..... *H01F 27/2847* (2013.01); *H01F 27/306* (2013.01); *H01F 27/325* (2013.01)

(58) Field of Classification Search

CPC ..... H01F 5/06; H01F 5/02; H01F 2017/048; H01F 27/2847; H01F 27/306; H01F 27/325

USPC ..... 336/212, 198, 208, 192, 199

See application file for complete search history.

(56) References Cited

U.S. PATENT DOCUMENTS

| | | | | |
|---|---|---|---|---|
| 2008/0290979 | A1* | 11/2008 | Suzuki | H01F 5/02 336/192 |
| 2014/0230238 | A1* | 8/2014 | Ueno | H01F 37/00 29/602.1 |
| 2014/0266527 | A1 | 9/2014 | Vafakhah et al. | |

FOREIGN PATENT DOCUMENTS

| | | | |
|---|---|---|---|
| JP | 2012-49269 | A | 3/2012 |
| JP | 2014-199872 | A | 10/2014 |
| JP | 2015-046481 | A * | 3/2015 |
| JP | 2015-46481 | A | 3/2015 |

* cited by examiner

*Primary Examiner* — Mangtin Lian

(74) *Attorney, Agent, or Firm* — Nath, Goldberg & Meyer; Jerald L. Meyer

(57) ABSTRACT

A reactor includes a core, a resin cover provided around the core, and a coil disposed around the core at the external side of the resin cover. The coil includes a conductive wire having a self-fusing layer formed on the surface of the conductive wire, and the adjoining conductive wire portions are bonded together by the self-fusing layer. The resin cover includes a bonding portion provided at a part of the resin cover and facing the end portion of the coil, and the end portion of the coil are bonded with the resin cover by an adhesive at the bonding portion.

5 Claims, 5 Drawing Sheets

REACTOR

CROSS REFERENCE TO RELATED APPLICATIONS

This application claims priority to Japanese Patent Application No. 2015-103960 filed on May 21, 2015, the entire contents of which are incorporated by reference herein.

FIELD OF THE INVENTION

The present invention relates to a reactor that has an improved fixation structure for a coil.

BACKGROUND

For example, a reactor for a vehicular booster circuit has been known which includes a resin cover (also called a bobbin) that covers the circumference of an annular magnetic core, and a coil provided around the outer circumference of the resin cover.

As disclosed in JP 2014-199872 A and JP 2012-049269 A, according to such a type of conventional reactors, the entire reactor is housed in the casing, and a filler is applied and solidified between the reactor and the casing.

In the case of, for example, vehicular reactors that have a large amount of heat generation when a current flows, it is necessary to improve cooling efficiency. For that purpose, it is proposed to make the coil surface exposed so as to allow such a portion to be directly in contact with a cooling medium, such as a cooling oil or an air. For example, US 2014/266527 A and JP 2015-046481 A disclose that oils are applied to the reactor for cooling, and according to this type of reactors, elimination of the filler improves the cooling efficiency.

According to conventional reactors that utilize the filler, the filler eliminates a gap between conductive wire portions that form a coil, and a gap between the coil and the resin cover around the core, and thus generation of noises due to vibrations of the conductive wire of the coil and the resin cover when a current flows through the reactor is suppressed. In the case of reactors that do not utilize the filler, however, such an effect is not accomplished, and thus vibrations and noises may be generated.

In general, according to reactors, in order to connect the coil to an external electric circuit, a drawn portion of the coil end portion is connected to the terminal of the electric circuit by, for example, welding. In the case of reactors that do not utilize the filler, however, stress may be applied to a connection portion between the coil and the terminal due to vibrations of the coil, possibly causing a break-down in a long-term use.

SUMMARY OF THE INVENTION

The objective of the present invention is to provide a reactor which has a little generation of vibration and noise, and suppresses an application of stress to a connection portion between the coil and an electric circuit by intimately contacting wound portions of the conductive wire forming the coil to obtain an integrated coil, and bonding the coil with a resin cover.

The reactor according to an aspect of the present invention employs the following structures.

(1) The reactor comprises a core, a resin cover provided around the core, and a coil disposed around the core at an external side of the resin cover.

(2) The coil includes a conductive wire having a self-fusing layer formed on a surface of the conductive wire, the adjoining conductive wire portions being bonded together by the self-fusing layer.

(3) The resin cover includes a bonding portion provided at a part of the resin cover and facing an end portion of the coil, the end portion of the coil being bonded with the resin cover by an adhesive at the bonding portion.

Preferably, the reactor according to the present invention further employs the following structures.

(1) No filler for fixing the resin cover to the coil is provided at the resin cover and an outer circumference of the coil, and at least the coil is capable of contacting a cooling medium that cools the reactor.

(2) The bonding portion is a wall portion provided on the resin cover, and the end portion of the coil is bonded with the wall portion.

(3) The wall portion is formed with an opening exposing a part of the bonded conductive wire.

(4) The bonding portion is a flat plane formed on a surface of the resin cover, and the end portion of the coil is bonded with the flat plane.

(5) The bonding portion is formed on an opposing surface of the resin cover to the end portion of the coil, is an inclined portion that eliminates a gap therebetween, and the end portion of the coil is bonded with the inclined portion.

(6) The conductive wire is a flat rectangular wire, and a flat surface of the flat rectangular wire is bonded with a bonding surface of the resin cover.

(7) The end portion of the coil is bonded with the resin cover by the self-fusing layer of the coil.

(8) At least a part of the core pieces forming the core in an annular shape is embedded in the resin cover.

It is noted that according to the present invention, the term "end portion of a coil" indicates the final turn portion of a conductive wire or the drawn portion thereof. In addition, like illustrated embodiments to be explained below, when a single conductive wire is wound to form a plurality of coils, the turned portion of the conductive wire exposed at the end portion of each coil is also referred to as the end portion of a coil.

According to the present invention, since the whole coil is integrated by the self-fusing layer, and the end portions of the coil are stationary fixed to the resin cover by the self-fusing layer, vibrations and noises of the coil are suppressed, stress to be applied to the connection portion between the drawn portion and the terminal is reduced, and thus a highly reliable reactor is accomplishable.

DETAILED DESCRIPTION OF THE EMBODIMENTS

Figure 1:
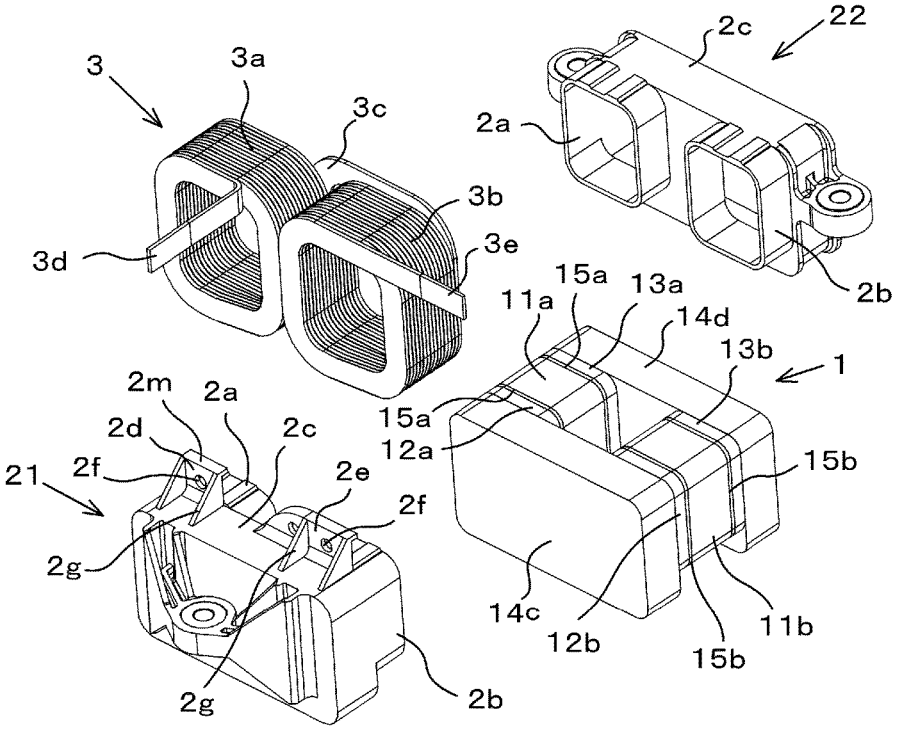
FIG. 1 is an exploded perspective view of a reactor according to a first embodiment of the present invention.
Figure 2:
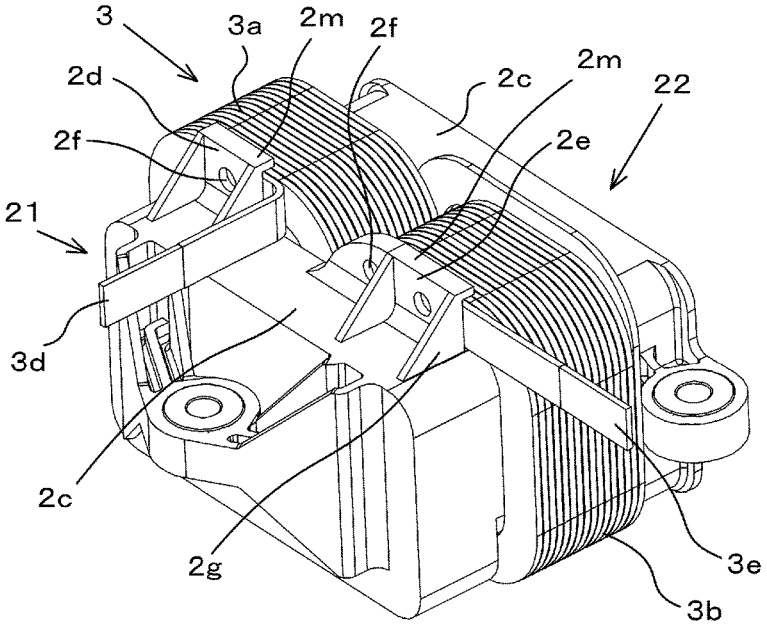
FIG. 2 is a perspective view for the first embodiment.
Figure 3:
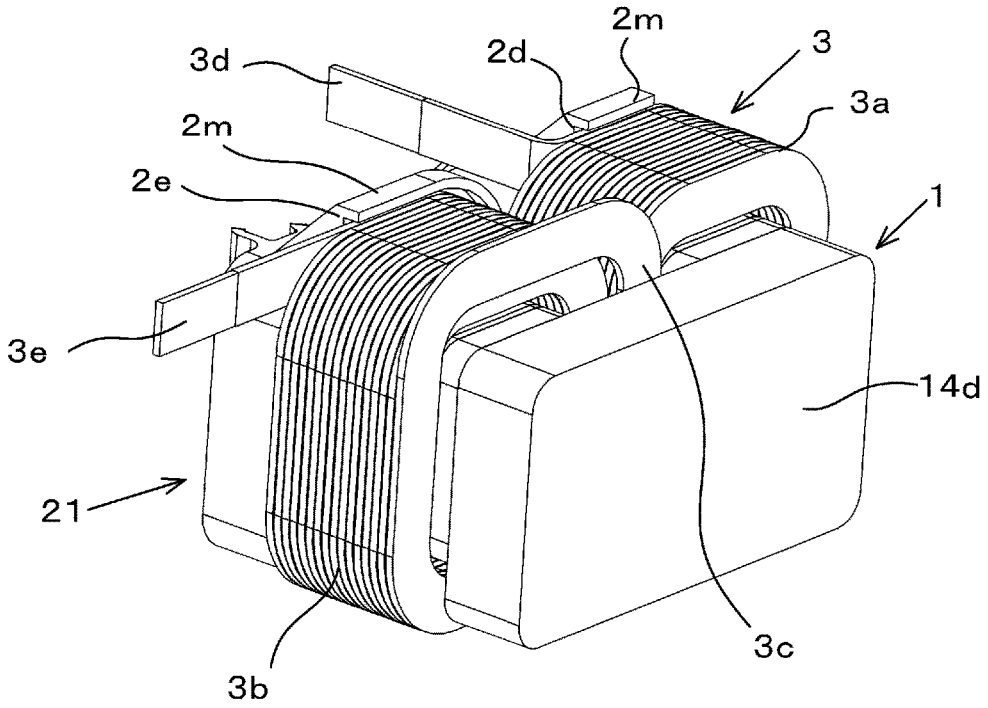
FIG. 3 is a perspective view for the first embodiment as viewed from a coil-side.
Figure 4:
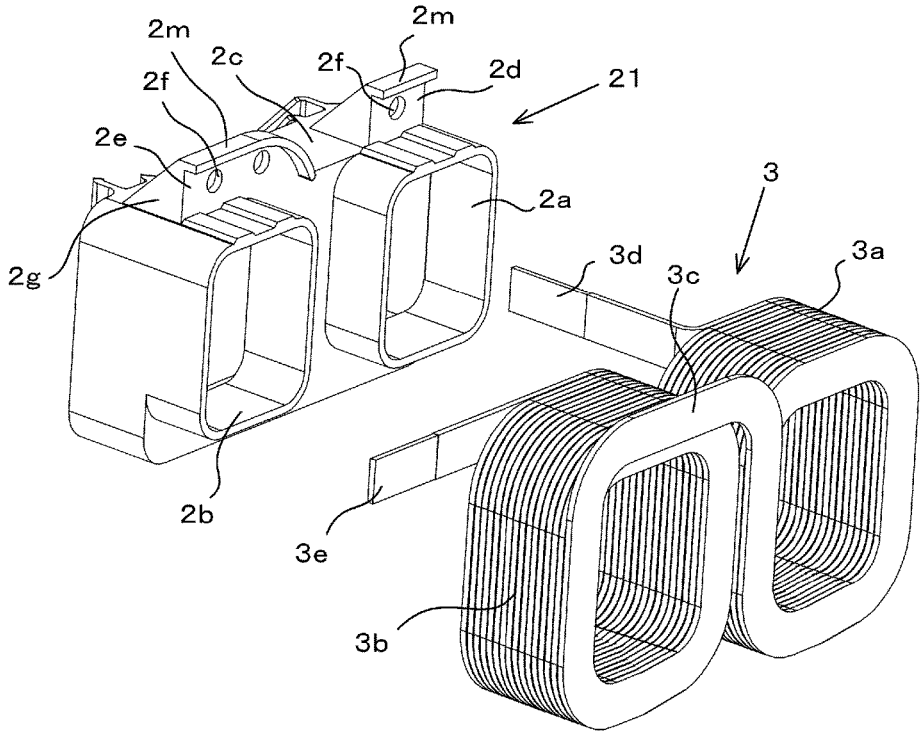
FIG. 4 is an exploded perspective view for the first embodiment as viewed from the coil-side.

Embodiments of the present invention will be explained in detail with reference to the accompanying figures.

1. First Embodiment (1) Structure

A reactor according to this embodiment includes an annular core 1, first and second resin covers 21, 22 covering the circumference of the core 1, and a coil 3 attached to the leg portions of the core 1. The annular core 1 is a powder magnetic core formed of pure iron, sendust, or Fe—Si alloy, a ferrite magnetic core, or a magnetic body like laminated steel sheets.

The annular core 1 includes two thick I-shaped cores 11*a*, 11*b* that form the right and left leg portions, four thin I-shaped cores 12*a*, 13*a*, 12*b*, 13*b* bonded with both sides of the respective thick cores 11*a*, 11*b*, and two block-shape cores 14*c*, 14*d* that form yokes. Those core pieces are bonded in a rectangular shape. According to this embodiment, spacers 15*a*, 15*b* that form respective magnetic gaps are fitted in bonding portions between the two thick I-shaped cores 11*a*, 11*b* and the four thin I-shaped cores 12*a*, 13*a*, 12*b*, 13*b* bonded with both ends of the respective thick cores 11*a*, 11*b*, but such spacers 15*a*, 15*b* may be utilized as appropriate in accordance with the presence/absence of the magnetic gap. Hence, the present invention is applicable to an annular core that has no spacer.

As for bonding of those cores to each other or bonding the core with the spacer, for example, an epoxy-based adhesive is preferable. When, in particular, a cooling medium that is a vehicular cooling oil like an Automatic Transmission Fluid (ATF) for a transmission is applied, in view of the oil-proof performance, the epoxy-based adhesive is preferable, but when other cooling media are applied, other adhesives, such as silicon-based, acrylic-based, and poly-urethane-based adhesives, or a mixed adhesive of two or more kinds of the foregoing adhesives are also applicable.

The coil 3 includes two wound portions 3*a*, 3*b* attached to the respective outer circumferences of the right and left leg portions 11*a*, 11*b* of the annular core 1. The two wound portions 3*a*, 3*b* are connected to each other via a connection portion 3*c* formed at respective one-end sides of those wound portions 3*a*, 3*b*. In this embodiment, the final turn portions of the two wound portions 3*a*, 3*b* are located at the same-direction-side of the coil, and drawn portions 3*d*, 3*e* for a connection to an external electric circuit are drawn from the respective final turn portions. In this case, the first drawn portion 3*d* is drawn in parallel with the axial direction of the coil, while the second drawn portion 3*e* is drawn in an orthogonal direction to the axial direction of the coil.

As for coil 3, applied is a "self-fusing coil" that has a self-fusing layer which is formed of a thermosetting resin, etc., in a semi-cured condition, and which is formed on the surface of the conductive wire including an insulation covering formed on the outer circumference of an electric wire. The "self-fusing coil" needs no other adhesive and molding resin, causes the resin formed on the surface of the conductive wire to be fused by heating the conductive wire, and to bond the adjoining conductive wire portions to each other, thereby integrating the conductive wire. An example resin applicable for the self-fusing layer is a phenol resin, an epoxy resin, a polyimide resin, or a resin that has some epoxy resin components modified with a phenol resin, and according to this embodiment, a fusing covering formed of an epoxy-resin-based base resin and a curing agent and in a semi-cured condition is applied.

The conductive wire is not limited to any particular one, but according to this embodiment, an edgewise coil formed of a flat rectangular wire is applied. The edgewise coil has the shorter side of the flat rectangular wire as an internal diameter surface, and is wound in the vertical direction. In comparison with coils obtained by winding a round wire, since the cross-section is rectangular, the winding cross-sectional area is large, and the space factor is high. In addition, unlike round wires, it is unnecessary to wind the flat rectangular wire in multiple layers, and merely a single layer winding is fine. Hence, the internal-external temperature difference of the winding is little, and the heat-dissipation performance is high. Accordingly, a temperature rise is little. In view of such advantages, the edgewise coil is suitable for the coil of a high-efficiency reactor.

According to such a self-fusing edgewise coil, in comparison with conventional technologies that have a coil obtained by winding a flat rectangular wire and integrated by impregnation or resin molding, the process difficulty at the time of impregnation and a damage to the insulation covering of the conductive wire at the time of die molding can be prevented by applying the flat rectangular wire including the self-fusing layer. In addition, since the self-fusing edgewise coil is capable of being directly in contact with a cooling medium, the cooling efficiency is high in comparison with coils that have an impregnated resin or a resin molding around the conductive wire.

The first and second resin covers 21, 22 are formed of a heat resistance material, such as a poly-phenyl-sulfide (PPS) resin, that withstands a temperature higher than the bonding temperature of the self-fusing layer. In addition, other materials having a heat resistance can be used, such as a saturated-polyester-based resin, an urethane resin, an epoxy resin, a bulk molding compound (BMC), and polybutylene terephthalate (PBT), etc.

The first and second resin covers 21, 22 include respective covering portions 2*c* in which the block-shape cores 14*c*, 14*d* are embedded, respectively, and right and left bobbins 2*a*, 2*b* integrated with the respective covering portions 2*c*. The first resin cover 21 is combined with, in an annular shape, the second resin cover 22 that has likewise the yoke portion and the right and left portions, and the wound portions 3*a*, 3*b* of the coil 3 are attached to the outer circumferences of the bobbins 2*a*, 2*b*, and thus the reactor is formed.

The right and left bobbins 2*a*, 2*b* are formed in a cylindrical shape. In a state that the first and second resin covers 21, 22 are combined with each other, the thick I-shaped cores 11*a*, 11*b*, the thin I-shaped cores 12*a*, 13*a*, 12*b*, 13*b*, and the spacers 15*a*, 15*b* that form the leg portions of the annular core are fitted in the right and left bobbins 2*a*, 2*b* of both covers. As explained above, the thick I-shaped cores 11*a*, 11*b*, the thin I-shaped cores 12*a*, 13*a*, 12*b*, 13*b* and the spacers 15*a*, 15*b* are bonded together by an adhesive.

Tabular wall portions 2*d*, 2*e* are formed on the upper portion of the first resin cover 21 in the orthogonal direction to the axial direction of the coil so as to face the final turn portions of the conductive wire exposed at the ends of the wound portions 3*a*, 3*b* of the coil. The respective final turn portions of the conducive wire are bonded with the wall portions 2*d*, 2*e* by an adhesive. In this case, according to this embodiment, since the conductive wire is a flat rectangular wire, the flat surface of the flat rectangular wire is bonded so as to overlap the bonding surface of the first resin cover 21.

An example adhesive for bonding the wall portions 2*d*, 2*e* with the final turn portions of the conductive wire is an epoxy-based adhesive that is the same as the adhesive for bonding the core and the spacer, but other adhesives are also applicable. Alternatively, the adhesive according to the present invention may include the self-fusing layer, that is, the self-fusing layer that covers the conductive wire can be utilized. The final turn portions of the conductive wire may be bonded with the wall portions 2*d*, 2*e* by the self-fusing layer formed on the conductive wire.

Openings 2*f* are formed in the respective wall portions 2*d*, 2*e*. The opening 2*f* exposes a part of the bonded conductive wire from the opposite side of the bonded surface to the conductive wire. That is, according to this embodiment, no filler that stationary fixes the resin cover and the coil is present at the resin cover and the outer circumference of the coil, and thus the coil is capable of contacting a cooling medium that cools the reactor, and this cooling medium is capable of contacting the surface of the conductive wire through the opening 2*f*. Reinforcement ribs 2*g* are provided between the respective wall portions 2*d*, 2*e* and the surface of the first resin cover 21, while avoiding the locations of the openings 2*f*.

(2) Manufacturing Method

The reactor according to this embodiment is manufactured as follow.

First, the flat rectangular wire that has the self-fusing layer formed on the surface thereof is wound in an edgewise manner, thereby forming the coil 3 that has the right and left wound portions 3*a*, 3*b* and the connection portion 3*c*. In this case, the winding work of the flat rectangular wire is carried out at a normal temperature so that the self-fusing layer on the surface is prevented from being fused to bond the adjoining flat rectangular wire portions with each other.

After the coil 3 is formed, the coil 3 and the first and second resin covers 21, 22 are combined together so that the annular core 1 and the bobbins 2*a*, 2*b* are inserted through the wound portions 3*a*, 3*b*. That is, when forming the first and second resin covers 21, the block-shape cores 14*c*, 14*d* are molded in such covers, thereby embedding the yoke portion of the annular core 1.

In this condition, the spacers 15*a*, 15*b*, and the I-shaped cores 11*a*, 11*b*, 13*a*, 13*b* are fitted in and bonded with the bobbins 2*a*, 2*b* of either resin cover, e.g., the second resin cover 22, and the two wound portions 3*a*, 3*b* are attached to the external sides of the bobbins 2*a*, 2*b*. In addition, the bobbins 2*a*, 2*b* of the first resin cover 21 are inserted through the wound portions 3*a*, 3*b*, respectively, to combine the first resin cover 21 with the second resin cover 22, while at the same time, the I-shaped core 14*c* embedded in the first resin cover 21 is bonded with the I-shaped cores 12*a*, 12*b*. In addition, the I-shaped cores 12*a*, 12*b* are bonded with the I-shaped cores 11*a*, 11*b* via the spacers 15*a*, 15*b*, respectively.

In this case, as for the bonding of each core with the spacer, for example, an adhesive formed of a thermosetting resin is applied beforehand, and is heated and cured simultaneously with the adhesive that is the self-fusing layer for bonding the conductive wire of the coil. The curing of the adhesive and the curing of the self-fusing layer may be carried out separately, and the adhesive for each core and the spacer may be cured prior to the self-fusing layer.

At this time, the adhesive is applied to the wall portions 2*d*, 2*e*, and the end portions of the coil 3 are bonded with the first resin cover 21. Subsequently, in a state that the end faces of the wound portions 3*a*, 3*b* are abutted on the wall portions 2*d*, 2*e*, respectively, the coil 3 and the first resin cover 21 are pressurized in the axial direction under a heating atmosphere of 140-200° C. In this case, a pressurizing jig like a die is abutted to the first resin cover 21, thereby preventing the coil 3 from contacting the pressurizing jig. The adhesive applied to the wall portions 2*d*, 2*e* may be heated and cured simultaneously with the curing of the adhesive for each core and the spacer and the adhesive that is the self-fusing layer, or may be heated and cured separately.

When the coil 3 is pressurized under the heating atmosphere, the resin that forms the self-fusing layer is melted, and the adjoining flat rectangular wire portions are bonded with each other by the melted resin bonds, and thus the whole coil is integrated. Simultaneously, the cured adhesive applied to the wall portions 2*d*, 2*e* stationary fixes the end portions of the coil 3 to the wall portions 2*d*, 2*e* of the first resin cover 21. Note that when the self-fusing layer is utilized as the adhesive, the end portions of the coil 3 are stationary fixed to the wall portions 2*d*, 2*e* of the first resin cover 21 by the melting self-fusing layer of the coil 3.

Although it is not illustrated in the figure, the second resin cover 22 attached to the opposite side of the coil 3 may be simultaneously combined with the coil 3 and heated and pressurized for integration. Needless to say, the heating and pressurizing process for the second resin cover 22 may be carried out in a separate step from the heating and pressurizing process for the coil 3.

According to this embodiment, since the first and second resin covers 21, 22 are formed of a PPS resin that shows a high heat resistance which has a melting point of substantially 280° C., no adverse effect is applied at the melting temperature of the self-fusing layer. Hence, although the self-fusing layer of the coil 3 is melted in the process, the pressurizing jig abutting the resin covers 21, 22 is easily removed from the surfaces of the first and second resin covers 21, 22 after the pressurization.

(3) Action and Effect

According to this embodiment, the following action and effect are accomplished.

(a) The adjoining conductive wire portions of the coil 3 are fixed and bonded by the adhesive layer that has the self-fusing function, and the whole coil 3 becomes a single body. Hence, the resonance point (frequency) of the coil 3 becomes high, and vibrations of the coil 3 itself are suppressed, while at the same time, since the end portions of the coil 3 are bonded with and stationary fixed to the wall portions 2*d*, 2*e* of the first resin cover 21 by an adhesive, the fixation of the coil 3 with the first resin cover 21 is further ensured, resulting in a suppression of vibrations of the coil 3. Consequently, generation of vibrations and noises when a current flows through the reactor is efficiently suppressed, and vibrations of the drawn portions 3*d*, 3*e* of the coil 3 are also suppressed. Accordingly, stress to be applied to the connection portion between the coil 3 and the terminal is reduced, and thus a possibility of a break-down of the connection portion in a long-term use decreases.

(b) According to this embodiment, the flat rectangular wire is utilized for the conductive wire of the coil 3, and the wall portions 2*d*, 2*e* that overlap the flat surface of the flat rectangular wire is provided at the first resin cover 21. Hence, a wide bonding area between the conductive wire and the first resin cover 21 is ensured, and thus the coil 3 is firmly bonded with the first resin cover 21.

(c) When the bonding between the coil 3 and the first resin cover 21 is accomplished by the self-fusing layer formed on the surface of the conductive wire, the bonding work is easy without a need of preparing an additional adhesive. In addition, the bonding of the wound portions of the coil 3 and the bonding of the first resin cover 21 with the end portions of the coil 3 may be carried out simultaneously by depressing the coil 3 against the wall portions 2*d*, 2*e* of the first resin cover 21 with the coil 3 being attached to the external side of the first resin cover 21, and thus the bonding works for both components are carried out further easily.

(d) According to the edgewise coil 3 formed by winding the flat rectangular wire, an unevenness is produced between the conductive wire portion at the winding start or end position and the next wound conductive wire portion overlapping therewith, and thus the end face of the coil 3 is not flat. Hence, when the first resin cover 21 and the end portion of the coil 3 are bonded together, a sufficient contact area therebetween is not ensured, and thus bonding force may decrease. Conversely, according to this embodiment, since the wall portions 2*d*, 2*e* to be bonded with the conductive wire are provided at the first resin cover 21, the bonding area between the end portions of the coil 3 and the first resin cover 21 are increased, ensuring a sufficient strength.

(e) According to this embodiment, since vibrations of the coil 3 and those of the drawn portions thereof are suppressed, it becomes unnecessary to stationary fix the coil 3 and the first resin cover 21 by a filler. Hence, although the coil 3 is exposed, the vibration suppression and the durability are still ensured, enabling the coil 3 to be directly in contact with the cooling medium like a cooling oil. Accordingly, the cooling efficiency of the reactor is improved.

(f) According to this embodiment, since the openings 2*f* are formed in the wall portions 2*d*, 2*e*, the cooling medium is capable of contacting the conductive wire even at the opposite surface to the bonding surface of the conductive wire. Hence, the conductive wire is further efficiently cooled.

2. Second Embodiment

Figure 5:
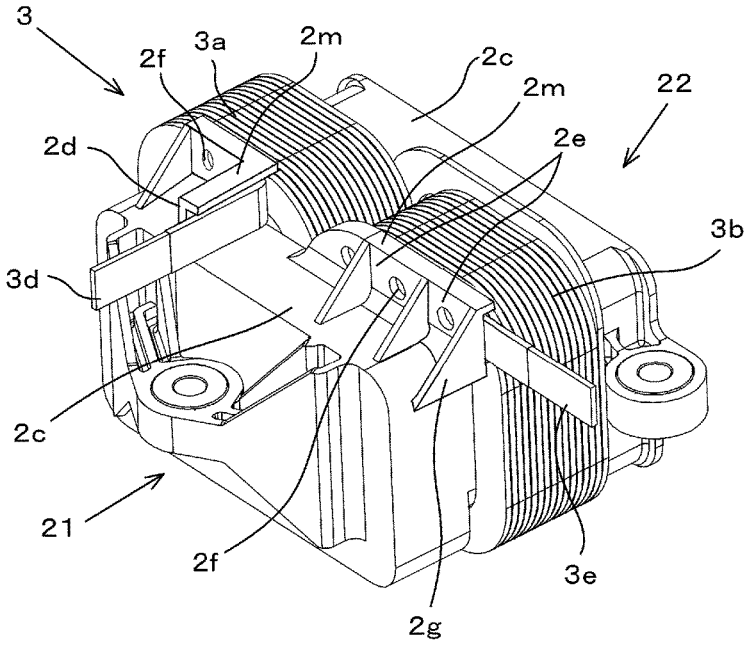
FIG. 5 is a perspective view for a second embodiment.

According to this embodiment, as illustrated in FIG. 5, the wall portions 2*d*, 2*e* provided on the resin cover 21 are extended in accordance with the positions of the drawn portions 3*d*, 3*e* of the conductive wire as well as the final turn portion of the conductive wire forming the coil 3. This enables a bonding of not only the final turn portion of the conductive wire but also the protruding drawn portions 3*d*, 3*e* of the coil 3 with the wall portions 2*d*, 2*e*, and thus a further firm fixation of the conductive wire is accomplishable. Consequently, even the connection portions between the drawn portions 3*d*, 3*e* and the terminals are apart from each other, vibrations of the drawn portion are efficiently suppressed.

As explained above, according to this embodiment, the positions of the wall portions 2*d*, 2*e* and the shapes thereof are modifiable in accordance with the directions of the drawn portions 3*d*, 3*e* and the position of the connection portion with the terminal.

3. Third Embodiment

Figure 6:
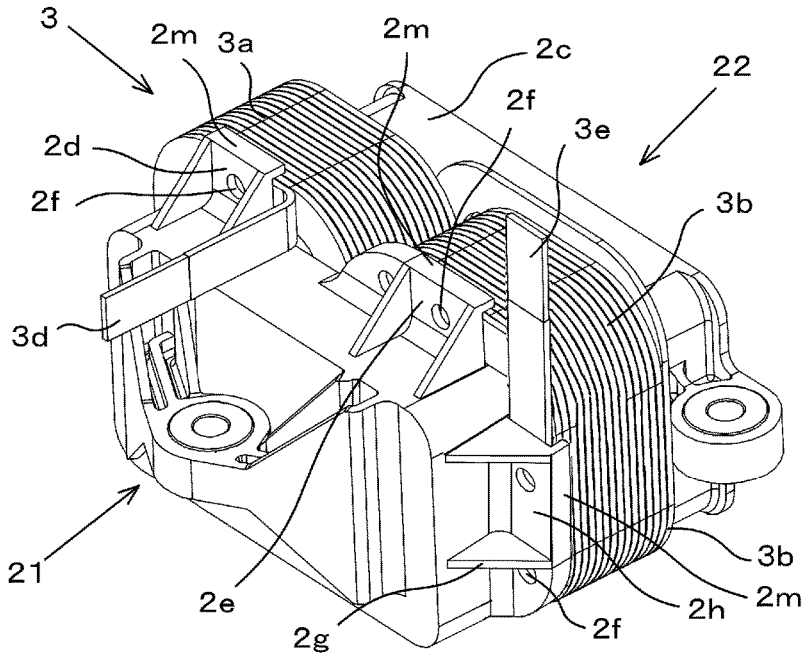
FIG. 6 is a perspective view for a third embodiment.

According to this embodiment, as illustrated in FIG. 6, as the bonding portions, in addition to the upper wall portions 2*d*, 2*e* on the upper surface of the first resin cover 21, wall portions 2*h* that support the drawn portions 3*d*, 3*e* of the conductive wire, respectively, are provided at the side faces of the reactor. That is, various positions of the drawn portions 3*d*, 3*e* of the conductive wire are expected in accordance with the position of the terminal to be connected to the external electric circuit, and the position of the wall portion 2*h* is modifiable as appropriate in accordance with the positions of the drawn portions 3*d*, 3*e* like this embodiment.

4. Fourth Embodiment

Figure 7:
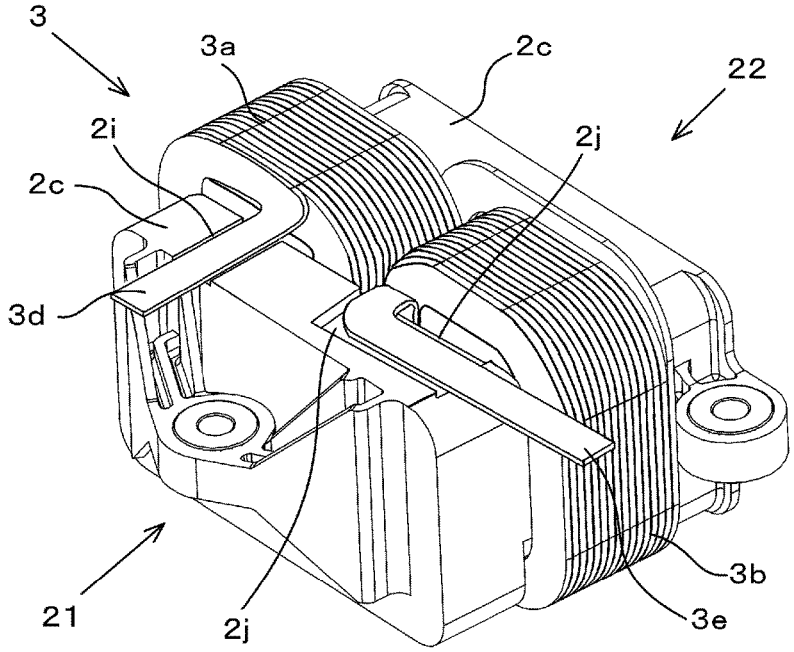
FIG. 7 is a perspective view for a fourth embodiment.

According to this embodiment, as illustrated in FIG. 7, flat planes 2*i*, 2*j* where the drawn portions 3*d*, 3*e* of the conductive wire overlap are formed on the upper surface of the first resin cover 21, and the flat planes 2*i*, 2*j* are utilized as the bonding portions with the drawn portions 3*d*, 3*e*. That is, the flat planes 2*i*, 2*j* are overlapped and bonded with the flat surface of the flat rectangular wire. In this case, the flat planes 2*i*, 2*j* are provided along the extending directions of the respective drawn portions 3*d*, 3*e*, and may be provided along the axial direction of the coil, or may be provided along the orthogonal direction to the axial direction of the coil. In addition, as illustrated in FIG. 7, the flat planes 2*i*, 2*j* may be the bottom surfaces of respective grooves concaved from the upper surface of the first resin cover 21. By disposing the drawn portions on the groove flat planes 2*i*, 2*j* as explained above, the improved bonding strength between the drawn portions 3*d*, 3*e* and the first resin cover 21 is accomplishable.

5. Fifth Embodiment

Figure 8:
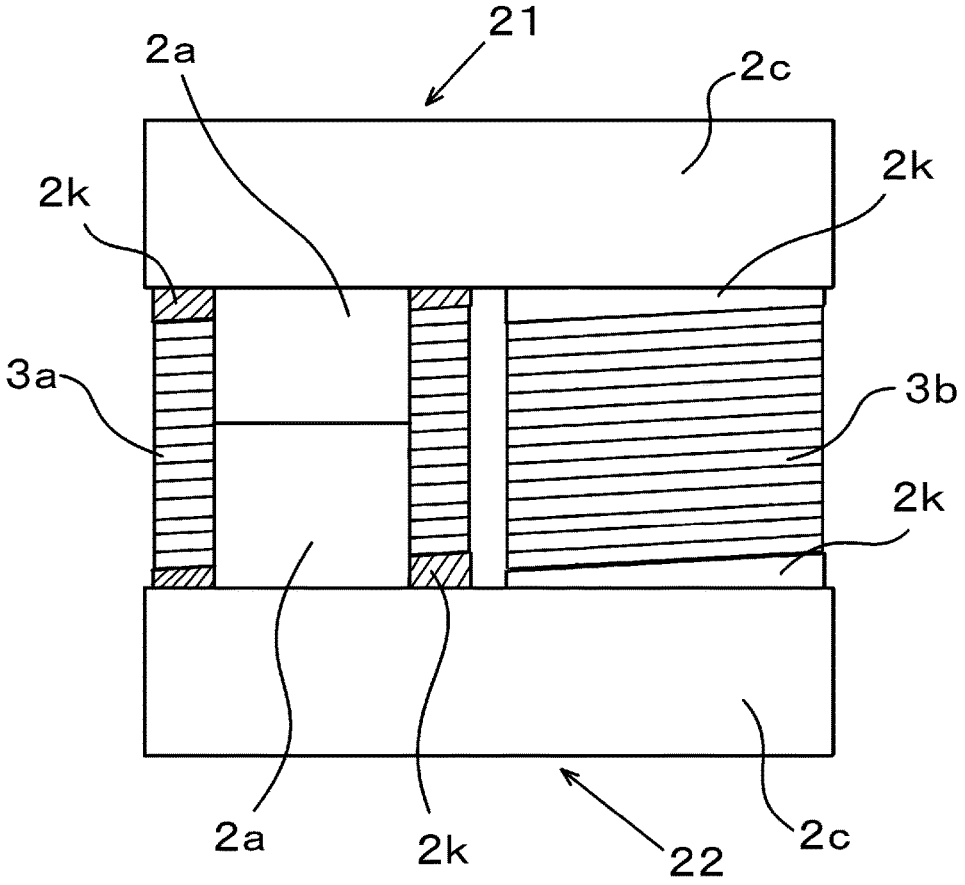
FIG. 8 is a plan view for a fifth embodiment.

According to this embodiment, as illustrated in FIG. 8, a resin is overlaid on the opposing surfaces of the first and second resin covers 21, 22 to the coil end faces so as to eliminate the gap therebetween, thereby increasing the bonding area. That is, the final turn portion of the coil 3 is formed by winding the conductive wire, thus inclined relative to the surfaces of the first and second resin covers 21, 22. Hence, if the resin cover is simply superimposed on the coil, a gap is formed. Hence, according to this embodiment, Inclined portions 2*k* inclined in accordance with the angle of the conductive wire of the coil 3 are formed as the bonding portions on the opposing surfaces of the resin covers 21, 22 to the coil end faces. That is, the inclined portions 2*k* is overlapped and bonded with the flat surface of the flat rectangular wire.

As illustrated in a planar view of the right wound portion 3*b* of FIG. 8, the inclined portions 2*k* is formed in a ring shape in accordance with the final turn portions of the coil 3, and as illustrated in a cross-sectional view of the left wound portion 3*a* of FIG. 8, the projecting level from the surfaces of the first and second resin covers 21, 22 are determined in accordance with the distance between the end faces of the coil 3 and the respective end faces of the resin covers 21, 22. According to this embodiment, the inclined portions 2*k* eliminates the gaps between the end faces of the coil 3 and the opposing faces of the resin covers 21, 22, and thus an enhanced bonding strength therebetween is accomplished.

6. Other Embodiments

The present invention is not limited to the above embodiments, and also covers the following other embodiments.

(1) The conductive wire that forms the coil 3 is not limited to the flat rectangular wire, and a round wire and a square wire are also applicable. How to wind the conductive wire to form the coil 3 is not limited to the edgewise winding, and other techniques like an α-winding are also applicable.

(2) Grooves, recesses, etc., may be formed in the bonding portions that are the wall portions 2*d*, 2*e* or the flat planes 2*i*, 2*j*. A conductor, such as the flat rectangular wire or a round wire may be fitted in such grooves and recesses, and the first resin cover 21 may be bonded with the drawn portions 3*d*, 3*e* by the self-fusing layer of the conductor.

(3) The openings 2*f* provided in the wall portions 2*d*, 2*e*, 2*h* are not limited to those in the illustrated embodiments. The shape of such an opening, such as a slit shape or a groove shape, and the number thereof are freely selectable, and as long as the ensured bonding strength is accomplishable, it is preferable to increase the opening 2*f* as large as possible to increase the contact area of the cooling medium with the drawn portions 3*d*, 3*e* for improved cooling performance. For example, the positions of the respective openings 2*f* are not limited to the overlapping portions of the wall portions 2*d*, 2*e*, 2*h* with the flat rectangular wire, and may be provided in flange portions 2*m* provided on the respective edges of the wall portions 2*d*, 2*e*, 2*h*.

(4) The shape of the annular core 1 is not limited to the illustrated rounded-corner rectangular shape, and may be in a track shape, a circular annular shape, a figure-of-eight shape, and the like. In addition, the present invention is applicable to the core that has three or more leg portions. When a core is created, in addition to the combination of the core pieces according to the illustrated embodiments, U-shaped, T-shaped, and E-shaped core pieces may be selected as appropriate and combined together to form the desired annular core 1. The shape of the coil 3 and the number thereof are also modifiable as appropriate in accordance with the shape of the core 1, etc.

(5) As for the combination of the resin covers with the core, the covers and the core may be prepared separately, and the core may be simply fitted in the resin covers, or like the illustrated embodiments, a part of the core may be embedded in and integrated with the resin covers by mold forming, insert molding, etc. When a part of the core is embedded in the resin covers, the improved fixation strength therebetween is accomplishable.

(6) According to the illustrated embodiments, the first resin cover 21 is provided with the bonding portions, such as the wall portions, the flat planes, and the inclined portions, but the similar bonding portions may be provided at the second resin cover 22, and the coil 3 may be bonded so as to be held between the two resin covers 21, 22 from both sides. In this case, the bonding between the coil 3 and the first and second resin covers 21, 22 is further ensured, and thus reduction of noises and vibrations of the reactor and improvement of the strength are accomplishable.

What is claimed is:

1. A reactor comprising:

a core;

a resin cover provided around the core; and a coil disposed around the core at an external side of the resin cover, wherein the coil comprises a conductive wire having a self-fusing layer formed on a surface of the conductive wire, the adjoining conductive wire portions being bonded together by the self-fusing layer, wherein the conductive wire is a flat rectangular wire having a rectangular cross-section; and the resin cover comprises a wall portion extended at a part of the resin cover and facing a final turn portion of the coil, the final turn portion of the coil being bonded with the resin cover by an adhesive at the wall portion, wherein a flat surface of the flat rectangular wire at the final turn portion is bonded at the wall portion.

2. The reactor according to claim 1, wherein no filler for fixing the resin cover to the coil is provided at the resin cover and an outer circumference of the coil, and at least the coil is capable of contacting a cooling medium that cools the reactor.

3. The reactor according to claim 1, wherein the wall portion is formed with an opening exposing a part of the bonded conductive wire.

4. The reactor according to claim 1, wherein the end portion of the coil is bonded with the resin cover by the self-fusing layer of the coil.

5. The reactor according to claim 1, wherein at least a part of the core pieces forming the core in an annular shape is embedded in the resin cover.

* * * * *